US009189956B2

(12) United States Patent
Kazama et al.

(10) Patent No.: US 9,189,956 B2
(45) Date of Patent: Nov. 17, 2015

(54) REMOTE CONTROLLER AND METHOD OF CONTROLLING LIGHT EMISSION FROM LIGHT-EMITTING UNIT THEREOF

(75) Inventors: Kouichi Kazama, Saitama (JP); Atsushi Usami, Kanagawa (JP); Shunichi Yanase, Kanagawa (JP)

(73) Assignees: Sony Corporation, Tokyo (JP); Sony Computer Entertainment Inc., Tokyo (JP)

( * ) Notice: Subject to any disclaimer, the term of this patent is extended or adjusted under 35 U.S.C. 154(b) by 673 days.

(21) Appl. No.: 13/359,612

(22) Filed: Jan. 27, 2012

(65) Prior Publication Data

US 2012/0194326 A1 Aug. 2, 2012

(30) Foreign Application Priority Data

Jan. 31, 2011 (JP) ..... 2011-019288

(51) Int. Cl.

| | |
|---|---|
| ***G08C 19/16*** | (2006.01) |
| ***G08C 23/04*** | (2006.01) |
| *G08C 17/02* | (2006.01) |

(52) U.S. Cl.

CPC ..... *G08C 23/04* (2013.01); *G08C 17/02* (2013.01); *G08C 2201/20* (2013.01); *G08C 2201/92* (2013.01); *G08C 2201/93* (2013.01)

(58) Field of Classification Search

CPC ..... G08C 23/04
USPC ..... 340/12.54; 341/176
See application file for complete search history.

(56) References Cited

U.S. PATENT DOCUMENTS

| | | | | |
|---|---|---|---|---|
| 6,236,350 | B1 * | 5/2001 | Andrews | 341/176 |
| 7,046,185 | B2 * | 5/2006 | Griesau et al. | 341/176 |
| 7,474,248 | B2 | 1/2009 | Nakamura | |
| 7,884,700 | B2 * | 2/2011 | Ishiguchi | 340/3.71 |
| 2002/0101358 | A1 * | 8/2002 | De Bolster et al. | 340/825.72 |
| 2005/0088315 | A1 * | 4/2005 | Klein et al. | 340/825.69 |
| 2006/0272001 | A1 * | 11/2006 | Miyazawa et al. | 725/139 |
| 2006/0290559 | A1 * | 12/2006 | Nakamura et al. | 341/176 |
| 2007/0057762 | A1 * | 3/2007 | Han et al. | 340/5.26 |
| 2008/0157993 | A1 * | 7/2008 | Du Breuil et al. | 340/825 |
| 2008/0291074 | A1 * | 11/2008 | Tzeng et al. | 341/176 |
| 2009/0051824 | A1 * | 2/2009 | Satou | 348/734 |
| 2011/0012772 | A1 * | 1/2011 | Chuang et al. | 341/176 |

(Continued)

FOREIGN PATENT DOCUMENTS

| | | | |
|---|---|---|---|
| CN | 201233652 | Y | 5/2009 |
| EP | 0556516 | A2 | 8/1993 |

(Continued)

OTHER PUBLICATIONS

Office Action for corresponding JP Application No. 2011-019288, dated Dec. 4, 2012.
Office Action for corresponding Chinese Patent Application No. 201210021430.2, dated Feb. 28, 2013.
European Search Report for corresponding EP Application 12152929.1, dated Mar. 10, 2014.

* cited by examiner

*Primary Examiner* — Naomi Small
(74) *Attorney, Agent, or Firm* — Matthew B. Dernier, Esq.

(57) ABSTRACT

When a key input acknowledging unit acknowledges user input from a valid key enabled to control a first electronic device, a light-emission control unit causes a first light-emitting unit for a first selection key to emit light. On the other hand, when the key input acknowledging unit acknowledges user input from a control key other than the valid key, the light-emission control unit causes a second light-emitting unit for a second selection key or a third light-emitting unit for a third selection key to emit light.

9 Claims, 8 Drawing Sheets

(56) References Cited

U.S. PATENT DOCUMENTS

| | | | | |
|---|---|---|---|---|
| 2011/0033167 | A1* | 2/2011 | Arling et al. | 386/234 |
| 2012/0288283 | A1* | 11/2012 | Meyer et al. | 398/115 |

FOREIGN PATENT DOCUMENTS

| | | | |
|---|---|---|---|
| JP | 662464 | A | 3/1994 |
| JP | 8214380 | A | 8/1996 |
| JP | 2005311549 | A | 11/2005 |
| JP | 2007006252 | A | 1/2007 |

FIG.6A

| | | |
|---|---|---|
| CURRENT DEVICE INFORMATION | AMP | IR |
| PREVIOUS DEVICE INFORMATION | AMP | IR |

80

FIG.6B

| | | |
|---|---|---|
| CURRENT DEVICE INFORMATION | GAME | BT |
| PREVIOUS DEVICE INFORMATION | AMP | IR |

80

FIG.6C

| | | |
|---|---|---|
| CURRENT DEVICE INFORMATION | TV | IR |
| PREVIOUS DEVICE INFORMATION | TV | IR |

80

FIG.6D

| | | |
|---|---|---|
| CURRENT DEVICE INFORMATION | GAME | BT |
| PREVIOUS DEVICE INFORMATION | TV | IR |

80

REMOTE CONTROLLER AND METHOD OF CONTROLLING LIGHT EMISSION FROM LIGHT-EMITTING UNIT THEREOF

BACKGROUND OF THE INVENTION

1. Field of the Invention

The present invention relates to a remote controller configured to transmit a control signal to an electronic device.

2. Description of the Related Art

Generally, electronic devices such as television and audio devices are provided with an infrared receiver unit and capable of receiving an infrared control signal from a remote controller. As the number of electronic devices increases, it will be bothering for the user to use remote controllers designed exclusively for respective electronic devices. In this background, a multi-remote controller capable of controlling a plurality of electronic devices is widely used.

[Patent Document No. 1] JP 6-62464

Some multi-remote controllers are provided with a plurality of selection keys for selecting an electronic device which the user wants to operate. When an electronic device subject to control is selected by user input from a selection key, a subsequently input control signal is transmitted to the selected electronic device. By indicating to the user to which electronic device the control signal is transmitted, the user can know that the control signal is properly transmitted to the selected electronic device. Particularly, where there are a plurality of electronic devices having the identical or similar function, the user can easily know the electronic device being controlled by showing the destination electronic device to which the control signal is transmitted.

As the number of electronic devices that can be remotely controlled by a remote controller increases, a plurality of communication means may be needed. Generally, a control signal is transmitted to a television or an audio device using infrared communication, while many of information processing devices such as game devices are not provided with an infrared light-receiving unit. For this reason, a control signal needs be transmitted using a communication protocol provided in the information processing device (e.g., the Bluetooth (registered trademark) wireless communication scheme, the wireless local area network (LAN) communication scheme, or the ZigBee (registered trademark) communication scheme). Since a remote controller is driven by a battery, it is favorable to reduce battery consumption as much as possible particularly when there are a plurality of communication means are installed.

SUMMARY OF THE INVENTION

Accordingly, a purpose of the present invention is to provide a remote controller provided with an indicator that notifies the user of the electronic device that is the transmission destination of a control signal. Another purpose of the present invention is to provide a remote controller capable of efficiently reducing battery consumption.

The remote controller that addresses the aforementioned challenge is configured to transmit a control signal to an electronic device, and comprises: a plurality of control keys; a first transmission unit provided with a function of transmitting a control signal; a second transmission unit provided with a function of transmitting a control signal; a plurality of selection keys configured to select a transmission destination of a control signal; an acknowledging unit configured to acknowledge user input from the plurality of control keys or from the plurality of selection keys; a plurality of light-emitting units configured to illuminate the plurality of selection keys, respectively; and a light-emission control unit configured to control light emission from the plurality of light-emitting units. The plurality of selection keys at least include: a first selection key configured to select a first electronic device to which the first transmission unit transmits a control signal; a second selection key configured to select a second electronic device to which the second transmission unit transmits a control signal; and a third selection key configured to select a third electronic device to which the second transmission unit transmits a control signal. When the acknowledging unit acknowledges the user input from among the plurality of control keys while an electronic device is selected, the light-emission control unit causes a light-emitting unit to emit light for a selection key corresponding to the selected electronic device.

Another embodiment of the present invention also relates to a remote controller configured to transmit a control signal to an electronic device. The remote controller comprises: a plurality of control keys; a first transmission unit provided with a function of transmitting a control signal; a second transmission unit provided with a function of transmitting a control signal; a plurality of selection keys configured to select a transmission destination of a control signal; an acknowledging unit configured to acknowledge user input from the plurality of control keys or from the plurality of selection keys; and an indicator control unit configured to control an indicator. The plurality of selection keys at least include: a first selection key configured to select a first electronic device to which the first transmission unit transmits a control signal; a second selection key configured to select a second electronic device to which the second transmission unit transmits a control signal; and a third selection key configured to select a third electronic device to which the second transmission unit transmits a control signal. When the acknowledging unit acknowledges the user input from among the plurality of control keys while an electronic device is selected, the indicator control unit causes an indicator of a selection key corresponding to the selected electronic device to change a status of the selection key.

Still another embodiment of the present invention relates to a method of controlling light emission from a light-emitting unit in a remote controller. The remote controller is provided with a plurality of control keys, a transmission unit having a function of transmitting a control signal, a plurality of selection keys configured to select a transmission destination of a control signal, and a plurality of light-emitting units configured to illuminate the plurality of selection keys, respectively. The light emission control method comprises: acknowledging user input from the plurality of control keys while an electronic device that is the transmission destination is selected; determining whether the acknowledged user input is valid or invalid for the selected electronic device; causing a light-emitting unit to emit light for a selection key corresponding to the selected electronic device if the acknowledged user input is valid for the selected electronic device; and causing a light-emitting unit to emit light, other than that for the selection key corresponding to the selected electronic device if the acknowledged user input is invalid for the selected electronic device.

Optional combinations of the aforementioned constituting elements, and implementations of the invention in the form of methods, apparatuses, systems, computer programs, data structures, and recording mediums may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIGS. 6A-6D show a relationship between current device information and previous device information;

DETAILED DESCRIPTION OF THE INVENTION

The invention will now be described by reference to the preferred embodiments. This does not intend to limit the scope of the present invention, but to exemplify the invention.

Figure 1:
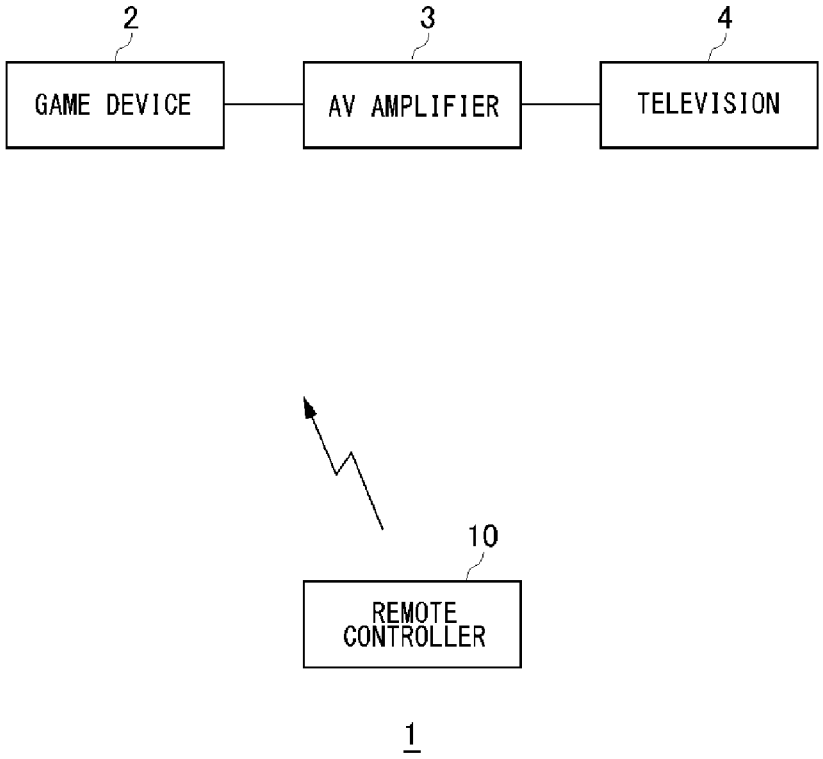
FIG. 1 shows a remote control system according to the embodiment of the present invention.

FIG. 1 shows a remote control system 1 according to the embodiment of the present invention. The remote control system 1 comprises a game device 2, a plurality of electronic devices such as an AV amplifier 3 and a television 4, and a remote controller 10 capable of controlling the electronic devices remotely. The game device 2, the AV amplifier 3 and the television 4 are remote controlled objects, and the user controls the electronic devices remotely using the remote controller 10.

The remote controller 10 is provided with a plurality of control keys, and a plurality of selection keys for selecting an electronic device that is a transmission destination of a control signal which is generated as the user operates (presses) a control key, i.e., for selecting an electronic device subject to remote control. In this embodiment, since three electronic devices, namely, the game device 2, the AV amplifier 3, and the television 4 are subject to remote control, the remote controller 10 is provided with three selection keys. The number of selection keys may be determined depending on the number of electronic devices subject to remote control. If there are four electronic devices subject to control, four selection keys are provided.

The game device 2 is provided with capabilities to communicate wirelessly using the Bluetooth (registered trademark) protocol (IEEE 802.15.1) and exchange a data signal related to a game with a game controller designed for the game device. The AV amplifier 3 and the television 4 has an infrared light-receiving unit having the function of receiving an infrared signal. For transmission of a control signal to these electronic devices, the remote controller 10 is provided with two communication means, namely, a communication module for Bluetooth and an infrared light-emitting unit. In the remote control system 1, the Bluetooth communication module of the remote controller 10 has the function of transmitting a control signal to the game device 2. The infrared light-emitting unit has the function of transmitting a control signal to the AV amplifier 3 and the television 4. As described, the remote controller 10 characteristically comprises a plurality of communication means.

When a selection key is operated to select an electronic device, the remote controller 10 converts subsequent user input from a control key into command data for the selected electronic device and transmits the resultant data to the electronic device as a control signal. Therefore, once an electronic device is selected, the remote controller 10 basically transmits a control signal to the selected electronic device. However, the remote controller 10 according to the embodiment may use the infrared light-emitting unit to transmit a control signal to the AV amplifier 3 or the television 4 even after the game device 2 is selected, provided that a particular control key is operated to provide user input.

Figure 2:
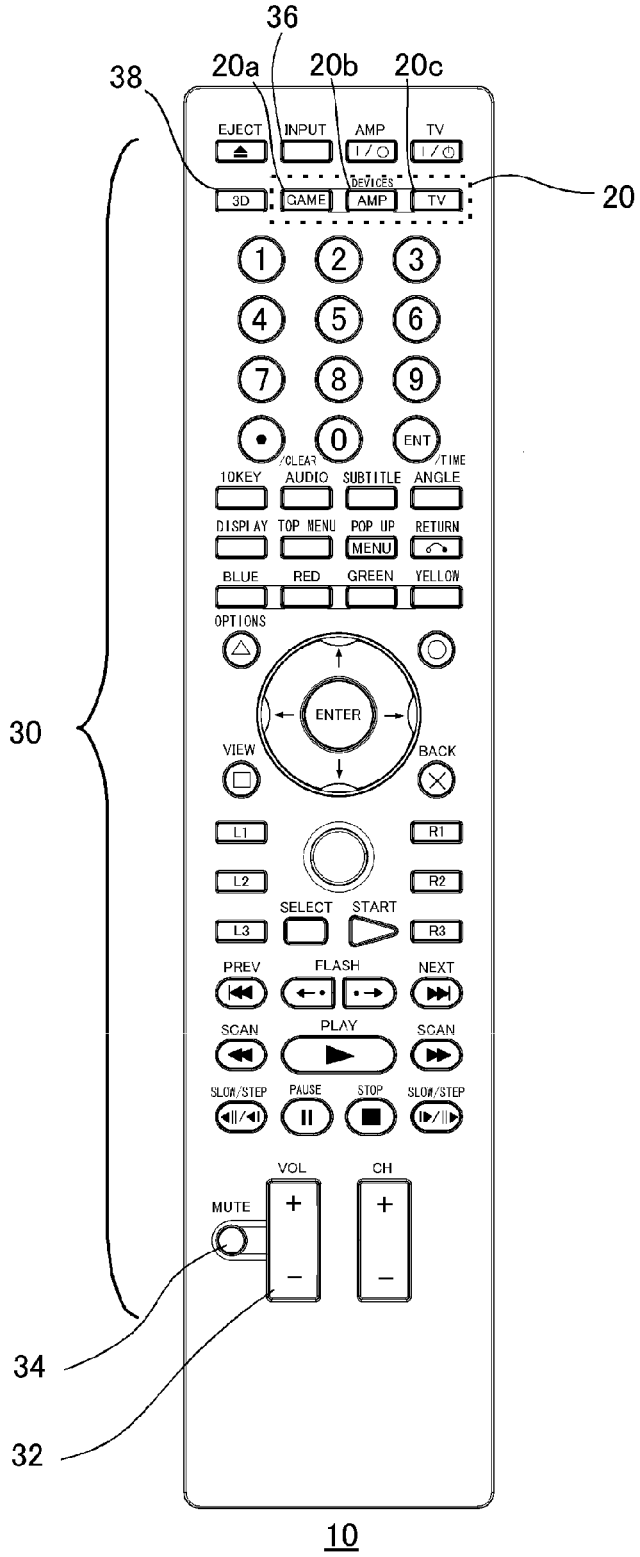
FIG. 2 shows an exemplary appearance of the remote controller according to the embodiment.

FIG. 2 shows an exemplary appearance of the remote controller 10 according to the embodiment. A control key group 30 comprising an arrangement of a plurality of control keys and a selection key group 20 comprising an arrangement of a plurality of selection keys are provided on the top surface (panel surface) of the remote controller 10. The control key group 30 includes control keys for use to control all electronic devices and control keys used to control one or two electronic devices. Of the plurality of control keys, a volume key 32 for adjusting the volume, a MUTE key 34 for turning the sound off, and an INPUT key 36 for switching the screen are not control keys enabled to control the game device 2. Therefore, even if the volume key 32, etc. is used while the game device 2 is being selected as a subject of remote control, the control signal is not transmitted to the game device 2. Further, a 3D key 38 for displaying a 3D screen is a control key enabled to control only the television 4.

The selection key group 20 comprises a GAME device selection key 20*a*, an AMP selection key 20*b*, and a TV selection key 20*c*. The GAME device selection key 20*a* is for selecting the game device 2, the AMP selection key 20*b* is for selecting the AV amplifier 3, and the TV selection key 20*c* is for selecting the television 4. A light-emitting unit is located below each selection key. When the light-emitting unit emits light, the selection key located above is illuminated.

FIG. 2 shows the remote controller 10 as a multi-remote controller for controlling a plurality of electronic devices. Alternatively, the remote controller 10 may be implemented by a mobile terminal with an application program installed therein to operate as a remote control device so as to be capable of being used as a remote controller 10. In other words, the remote controller 10 may be implemented by any device having the function of controlling a plurality of electronic devices remotely. For example, the remote controller 10 may be implemented by a general-purpose information terminal such as a smartphone, a tablet terminal, or a terminal with a keyboard. Still alternatively, the remote controller 10 may be a desktop computer. Thus, the remote controller 10 according to the embodiment may be any device capable of controlling an electronic device from a remote location. The remote controller 10 may be a dedicated device or a device provided with the capabilities for remote control by installing a program. FIG. 2 shows that the selection key group 20 and the control key group 30 each comprises push button keys. In case a smartphone is used as the remote controller 10, for example, the selection key group 20 and the control key group 30 may comprise software keys displayed on a touch panel.

The remote controller 10 shown in FIG. 2 is configured by fitting the upper casing and the lower casing together. The selection key group 20 and the control key group 30 are provided on the top surface of the upper casing. A communication module chip and a processor chip are fitted to a substrate provided in an interior space defined by the upper casing and the lower casing.

Figure 3:
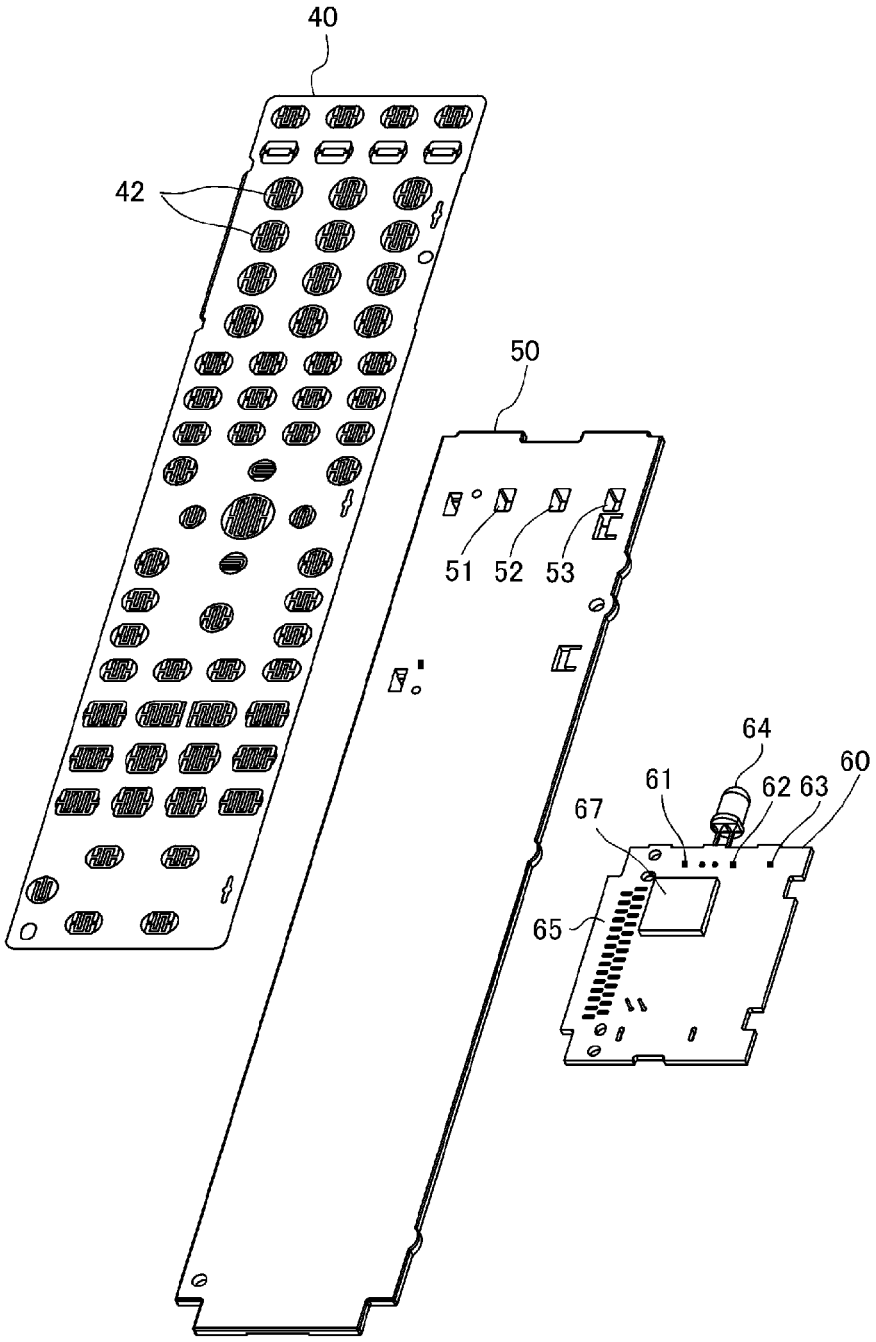
FIG. 3 is a perspective top view of the remote controller showing the contact sheet, the resin plate, and the substrate.
Figure 4:
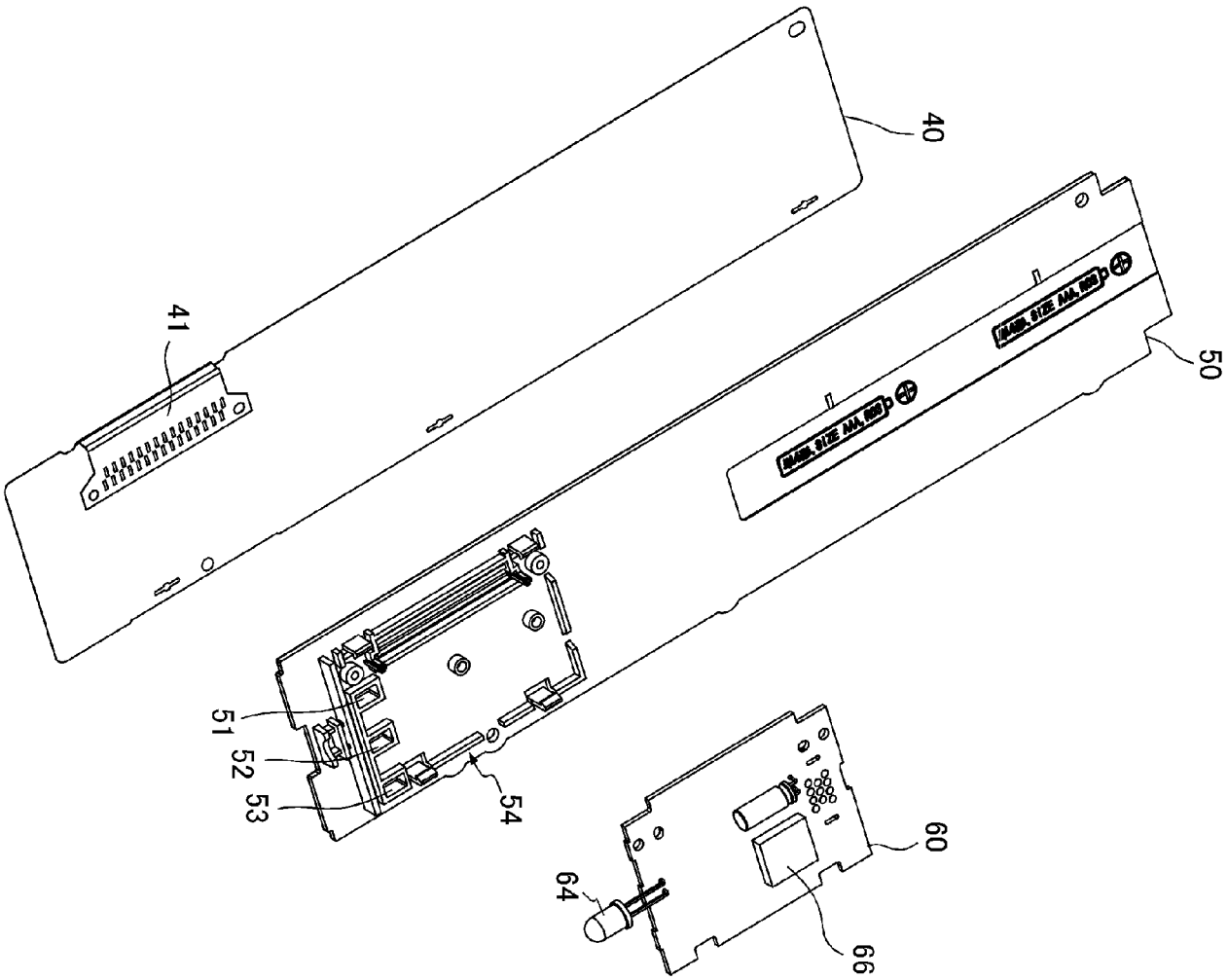
FIG. 4 is a perspective bottom view of the remote controller showing the substrate, the resin plate, and the contact sheet.

FIGS. 3 and 4 show the internal structure of the remote controller 10. A contact sheet 40, a resin plate 50, and a substrate 60 are provided inside the remote controller 10 in the stated order from top to bottom. FIG. 3 is a perspective top view of the remote controller 10 showing the contact sheet 40, the resin plate 50, and the substrate 60. FIG. 4 is a perspective bottom view of the remote controller 10 showing the substrate 60, the resin plate 50, and the contact sheet 40. Therefore, FIG. 3 shows the top surfaces of the contact sheet 40, the resin plate 50, and the substrate 60. FIG. 4 shows the lower surfaces of the substrate 60, the resin plate 50, and the contact sheet 40. FIGS. 3 and 4 show the contact sheet 40, the resin plate 50, and the substrate 60 isolated from each other. Actually, the contact sheet 40 and the substrate 60 are secured to the resin plate 50, and the resin plate 50 is secured to the upper casing or the lower casing. The resin plate 50 is manufactured by molding and is provided with a first hole 51, a second hole 52, and a third hole 53 at positions corresponding to the GAME device selection key 20*a*, the AMP selection key 20*b*, and the TV selection key 20*c* in the selection key group 20.

The substrate 60 is accommodated and secured in an accommodating unit 54 of the resin plate 50. A first light-emitting unit 61, a second light-emitting unit 62, a third light-emitting unit 63, a terminal part 65, and a micro processing unit (MPU) 67 are provided on the top surface of the substrate 60. The first light-emitting unit 61, the second light-emitting unit 62, and the third light-emitting unit 63 are implemented by a light-emitting diode (LED) and formed at positions corresponding to the first hole 51, the second hole 52, and the third hole 53 in the resin plate 50. An infrared light-emitting unit 64 and a Bluetooth communication module 66 are provided on the lower surface of the substrate 60. In the remote control system 1, the communication module 66 represents a first transmission unit having the function of transmitting a control signal and the infrared light-emitting unit 64 represents a second transmission unit having the function of transmitting a control signal. A Bluetooth antenna is formed in a free area on the lower surface (not shown).

The MPU 67 controls light emission from the first light-emitting unit 61, the second light-emitting unit 62, the third light-emitting unit 63, and the infrared light-emitting unit 64. The MPU 67 also controls communication by the communication module 66. When the first light-emitting unit 61 is caused to emit light, the light is guided by the hole 51 to illuminate the GAME device selection key 20*a*. Similarly, when the second light-emitting unit 62 is caused to emit light, the light is guided by the second hole 52 to illuminate the AMP selection key 20*b*, and, when the third light-emitting unit 63 is caused to emit light, the light is guided by the third hole 53 to illuminate the TV selection key 20*c*. The first light-emitting unit 61, the second light-emitting unit 62, and the third light-emitting unit 63 may emit light of the same color.

A plurality of contacts 42 corresponding to the positions of the keys provided on the upper casing of the remote controller 10 are formed on the top surface of the contact sheet 40. A contact 42 includes a pair of fixed contacts. A conductive rubber contact moved toward the bottom when the key is pressed is provided behind the key in the upper casing. When the key is pressed so that the conductive rubber contact comes into contact with the contact 42, the conductive rubber contact causes a pair of fixed contacts formed in the contact 42 to conduct electricity.

A lead 41 connected to the contact 42 is formed on the lower surface of the contact sheet 40. The terminal part 65 connected to the MPU 67 is formed on the top surface of the substrate 60. As the terminal of the lead 41 is connected to the terminal part 65, the MPU 67 identifies the contact 42 that conducts when the contact 42 conducts, and generates a command code for the key corresponding to the contact 42.

The substrate 60 according to the embodiment is configured as a multilayer substrate for carrying the Bluetooth communication module 66 thereon. The unit price of the substrate 60 is therefore high. If the substrate 60 is sized to extend through the entirety of the casing, the cost will be high, which is not favorable. For this reason, the substrate 60 is sized so that the MPU 67 and the Bluetooth communication module 66 are arranged with high density. Structurally, the total cost is reduced by forming, in the resin plate 50, the first hole 51, the second hole 52, and the third hole 53 for transmitting the light emitted from the first light-emitting unit 61, the second light-emitting unit 62, and the third light-emitting unit 63 to the top surface of the casing.

Figure 5:
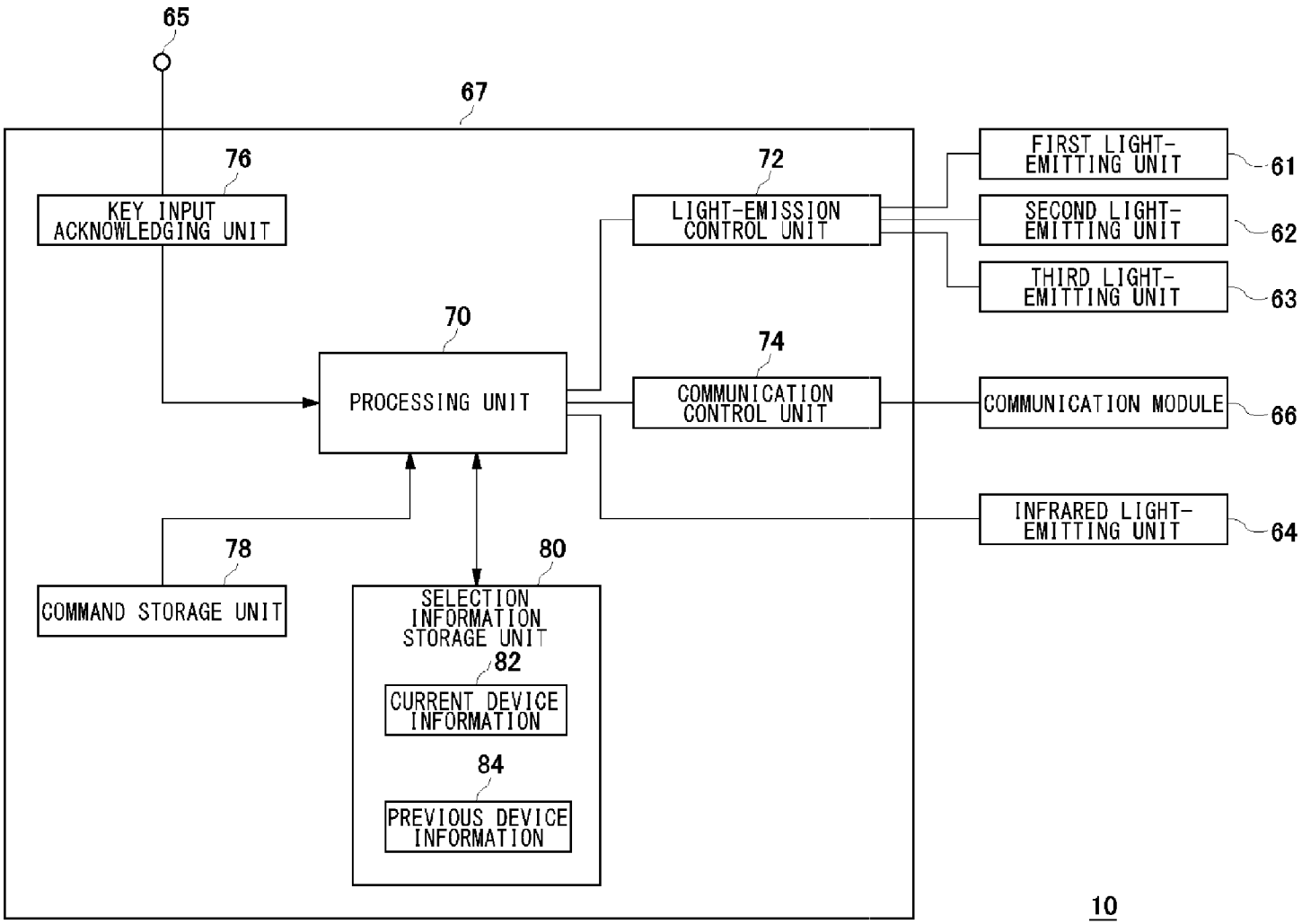
FIG. 5 shows functional blocks of the remote controller.

FIG. 5 shows functional blocks of the remote controller 10. The MPU 67 is provided with a processing unit 70, a light-emission control unit 72, a communication control unit 74, a key input acknowledging unit 76, a command storage unit 78, and a selection information storage unit 80. The functions of the MPU 67 are implemented by, for example, an arithmetic device, a memory and a program loaded into the memory. FIG. 5 depicts the functional blocks implemented by the coordination of these elements. Therefore, it will be obvious to those skilled in the art that the functional blocks may be implemented in a variety of manners by hardware only, software only, or a combination of thereof.

The remote controller 10 according to the embodiment is provided with two functions for transmitting a control signal. The first transmission function is implemented by the communication module 66. The communication module 66 transmits a control signal, including command data, to the game device 2 using the Bluetooth communication protocol. The second transmission function is implemented by the infrared light-emitting unit 64. The infrared light-emitting unit 64 transmits a control signal, including command data, to the AV amplifier 3 or the television 4. The control signal output from the communication module 66 and the control signal transmitted from the infrared light-emitting unit 64 have different formats. The control signals are similar in including information identifying a receiving device and command data.

The key input acknowledging unit 76 is connected to the terminal part 65 and acknowledges user input from the control key or the selection key. As described in connection with FIGS. 3 and 4, when a key of the remote controller 10 of the embodiment is pressed by a user, the pair of fixed contacts of the contact 42 located below the key conduct electrically. The contact 42 is connected to the key input acknowledging unit 76 via the lead 41 and the terminal part 65. The key input acknowledging unit 76 identifies a pressed key by detecting the contact 42 that conducts. The key input acknowledging unit 76 transmits information identifying the pressed key (input key information) to the processing unit 70.

The user using the remote controller 10 initially presses a selection key assigned to an electronic device sought to be controlled remotely, from the selection key group 20 (see FIG. 2). More specifically, if the user wishes to control the game device 2, the user presses the GAME device selection key 20*a*. If the user wishes to control the AV amplifier 3, the user presses the AMP selection key 20*b*. If the user wishes to control the television 4, the user presses the TV selection key 20*c*. When one of the selection keys is pressed, the processing unit 70 receives input key information for the selection key from the key input acknowledging unit 76. The processing unit 70 registers information identifying the selected electronic device in the selection information storage unit 80 as current device information 82. In the default state (e.g., the state occurring immediately after the battery is exchanged), the current device information 82 is configured to identify the game device 2.

The current device information 82 identifies one of the game device 2, the AV amplifier 3, the television 4 currently selected. The current device information 82 may directly identify an electronic device or identify one of the GAME device selection key 20*a*, the AMP selection key 20*b*, and the TV selection key 20*c* corresponding to the electronic devices. The processing unit 70 identifies the selected electronic device, i.e., the target of control, based on the current device information 82. Therefore, when the user starting to use the remote controller 10 presses the control key without pressing the selection key, the processing unit 70 basically processes the input key information for the control key as user input to control the electronic device identified by the current device information 82. The input key information for particular control keys of the remote controller 10 according to the embodiment is processed as user input to control the electronic device identified by previous device information 84.

When the processing unit 70 receives the input key information for the selection key, the processing unit 70 communicates information related to the pressed selection key to the light-emission control unit 72. The light-emission control unit 72 has the function of controlling light emission from the light-emitting units. When the light-emission control unit 72 receives information related to a selection key, the unit 72 causes the corresponding light-emitting unit to emit light for a predetermined period of time. For example, the light-emitting unit may emit light for approximately 500 ms. Therefore, when the GAME device selection key 20*a* is pressed, the first light-emitting unit 61 located below the GAME device selection key 20*a* emits light.

As shown in FIG. 5, the selection information storage unit 80 stores the previous device information 84 along with the current device information 82. The previous device information 84 indicates which of the AV amplifier 3 and the television 4 was selected before the GAME device selection key 20*a* is used to provide an input. In other words, the previous device information 84 identifies which of the AV amplifier 3 and the television 4 was last used. If the AMP selection key 20*b* was used to provide an input before the GAME device selection key 20*a* is used to provide an input, the previous device information 84 identifies the AV amplifier 3. If the TV selection key 20*c* was used to provide an input before the GAME device selection key 20*a* is used to provide an input, the previous device information 84 identifies the television 4.

The relationship between the current device information 82 and the previous device information 84 will be explained with reference to FIG. 6. Referring to FIG. 6, IR and BT denote information identifying a means of transmission in the remote controller 10. IR identifies the infrared light-emitting unit 64, and BT identifies the communication module 66.

FIG. 6A shows the content stored in the selection information storage unit 80 registered when the AMP selection key 20*b* is pressed. When the processing unit 70 receives the input key information for the AMP selection key 20*b*, the processing unit 70 configures the current device information 82 and the previous device information 84 to identify the AV amplifier 3. Since the previous device information 84 identifies one of the AV amplifier 3 and the television 4 selected last (most recently), the current device information 82 and the previous device information 84 both identify the AV amplifier 3 in this case. As shown, in addition to the information identifying an electronic device, information related to a transmission means for transmitting a control signal to the electronic device may be registered in the current device information 82 and the previous device information 84.

FIG. 6B shows the content stored in the selection information storage unit 80 registered when the GAME device selection key 20*a* is pressed after the AMP selection key 20*b* is pressed. When the processing unit 70 receives the input key information for the GAME device selection key 20*a*, the processing unit 70 does not update the previous device information 84 and configures the current device information 82 to identify the game device 2.

FIG. 6C shows the content stored in the selection information storage unit 80 registered when the TV selection key 20*c* is pressed. When the processing unit 70 receives the input key information for the TV selection key 20*c*, the processing unit 70 updates both the current device information 82 and the previous device information 84 to indicate the television 4. Since the previous device information 84 identifies one of the AV amplifier 3 and the television 4 selected last (most recently), the current device information 82 and the previous device information 84 both identify the television 4 in this case.

FIG. 6D shows the content stored in the selection information storage unit 80 registered when the GAME device selection key 20*a* is pressed after the TV selection key 20*c* is pressed. When the processing unit 70 receives the input key information for the GAME device selection key 20*a*, the processing unit 70 does not update the previous device information 84 and configures the current device information 82 to identify the game device 2.

The remote controller 10 according to the embodiment is enabled to control three electronic devices remotely. Of these, the remote control function is designed to primary control the game device 2. Given that the game device 2 is referred to as a main device and the AV amplifier 3 and the television 4, which support the main device, are referred to as sub devices, the content registered in the previous device information 84 is controlled so as to identify only a sub device that supports the main device and not to identify the main device.

Referring back to FIG. 5, the command storage unit 78 stores a command table of the electronic devices. The command table is configured to map information on control keys to command data for electronic devices. The command table may be installed in the device or generated by learning. The processing unit 70 refers to the command table of the electronic device subject to control and reads the command data corresponding to the control key.

When the key input acknowledging unit 76 acknowledges user input from the control key, the processing unit 70 receives the input key information for the control key from the key input acknowledging unit 76. When the processing unit 70 receives the input information for the control key, the unit 70 determines whether the input key information is for the 3D key 38. Since the 3D key 38 is a control key enabled to control only the television 4, the processing unit 70 refers to the command table for the television 4 upon receipt of the input key information for the 3D key 38 and reads the command data corresponding to the 3D key 38. The processing unit 70 controls light emission from the infrared light-emitting unit 64 and generates a control signal including the read command data, causing the infrared light-emitting unit 64 to transmit the control signal. Further, the processing unit 70 communicates information identifying the television 4, which is subject to control, to the light-emission control unit 72. This cause the light-emission control unit 72 to control the third light-emitting unit 63 for the TV selection key 20*c* corresponding to the television 4 to emit light for a predetermined period of time.

When the processing unit 70 receives the input key information other than that for the 3D key 38, the unit 70 refers to the current device information 82 and determines whether the received input key information is valid for the electronic device identified by the current device information 82.

Of the plurality of control keys, the volume key 32 for adjusting the volume, the MUTE key 34 for turning the sound off, and the INPUT key 36 for switching the screen are not used to generate a control signal to control the game device 2, as described with reference to FIG. 2. For example, the volume key 32 and the MUTE key 34 are keys to changing the volume. However, the game device 2 is not provided with the function of changing the volume.

For this reason, the plurality of control keys in the control key group 30 are grouped into valid keys that are enabled to control the electronic device identified by the current device information 82 and invalid keys that are not enabled to control the electronic device. In other words, the volume key 32, the MUTE key 34, and the INPUT key 36 of the game device 2 are invalid keys. The command table for the game device 2 does not store command data corresponding to the volume key 32, the MUTE key 34, and the INPUT key 36. The control keys other than the volume key 32, the MUTE key 34, and the INPUT key 36 are enabled to control the game device 2 and so corresponding command data are stored in the command table for the game device 2.

The processing unit 70 stores an invalid list listing invalid keys for each electronic device. When processing unit 70 receives input key information, the unit 70 refers to the invalid list and determines whether the input information is for a valid key or the information is for an invalid key. The list could be a valid list listing valid keys for each electronic device. In any case, the processing unit 70 can determine whether the input key information is for a valid key or the input key information is for an invalid key by referring to the list. In the embodiment, invalid keys are defined for the game device 2, but no invalid keys are defined for the AV amplifier 3 and the television 4. The 3D key 38 is a control key valid only for the television 4. Determination as to whether the 3D key 38 is pressed is made before determining as to whether an invalid key is pressed. Therefore, the following description concerns a process regarding control keys other than the 3D key 38.

Since no invalid keys are defined for the AV amplifier 3 and the television 4 in this embodiment, invalid lists need not be generated for the AV amplifier 3 and the television 4. Therefore, if the electronic device identified by the current device information 82 is the AV amplifier 3 or the television 4, the processing unit 70 may perform the subsequent process on the assumption that the input key information is valid key information.

<In Case the Input Key Information is Valid Key Information>

If the current device information 82 identifies the game device 2, the processing unit 70 refers to the command table for the game device 2 stored in the command storage unit 78 and reads the command data corresponding to the control key.

Having read the command data, the unit 70 refers to the current device information 82 and identifies the transmission means. If the current device information 82 identifies the game device 2, the processing unit 70 supplies the command data to the communication control unit 74 and directs the unit 74 to generate a control signal.

The communication control unit 74 has the function of controlling the communication module 66. Initially, the communication control unit 74 establishes a communication link between the communication module 66 and the game device 2. After the communication link is established, the communication control unit 74 supplies the command data to the communication module 66, whereupon the communication module 66 generates a control signal in a predetermined format and transmits the control signal to the game device 2 according to the Bluetooth protocol.

When the command data is not supplied from the processing unit 70 for a predetermined period of time (e.g., 10 minutes), the communication control unit 74 breaks the communication link between the communication module 66 and the game device 2. Since the remote controller 10 according to the embodiment is driven by a battery, it is not favorable to consume electric power wastefully. For this reason, the communication control unit 74 monitors arrival of command data from the processing unit 70. If command data that should be transmitted is not supplied for a predetermined period of time, the communication control unit 74 breaks the communication link between the communication module 66 and the game device 2 so as to reduce battery consumption.

If the current device information 82 identifies the AV amplifier 3, the processing unit 70 refers to the command table for the AV amplifier 3, reads the command data corresponding to the control key, and generates a control signal including the read command data and designating the AV amplifier 3 as the transmission destination. The processing unit 70 causes the infrared light-emitting unit 64 to transmit the generated control signal to the AV amplifier 3.

If the current device information 82 identifies the television 4, the processing unit 70 refers to the command table for the television 4, reads the command data corresponding to the control key, and generates a command signal including the read command data and designating the television 4 as the transmission destination. The processing unit 70 causes the infrared light-emitting unit 64 to transmit the generated control signal to the television 4.

In concurrence with the transmission process as described above, receiving the input key information for the control key, the processing unit 70 refers to the current device information 82 and notifies the light-emission control unit 72 of information identifying the electronic device subject to control. When the light-emission control unit 72 receives information identifying the selected electronic device, the light-emission control unit causes the light-emitting unit for the corresponding selection key to emit light for a predetermined period of time. For example, the light-emitting unit may emit light for 500 ms. Therefore, if the current device information 82 identifies the game device 2, the light-emission control unit 72 causes the first light-emitting unit 61 corresponding to the GAME device selection key 20*a* to emit light. If the current device information 82 identifies the AV amplifier 3, the light-emission control unit 72 causes the second light-emitting unit 62 corresponding to the AMP selection key 20*b* to emit light. If the current device information 82 identifies the television 4, the light-emission control unit 72 causes the third light-emitting unit 63 corresponding to the TV selection key 20*c* to emit light.

It is favorable that the light-emission control unit 72 cause the light-emitting unit to emit light in synchronization with transmission of a control signal. Therefore, the processing unit 70 may provide a command to emit light to the light-emission control unit 72 after confirming that a control signal is transmitted from the communication module 66 or the infrared light-emitting unit 64. The processing unit 70 may provide a command to emit light to the light-emission control unit 72 after confirming that transmission occurred in this way. To simplify the process, the processing unit 70 may provide a command to emit light to the light-emission control unit 72 without confirming transmission. Time required to transmit a control signal and time required to cause a light-emitting unit to emit light are very short. Irrespective of whether transmission is confirmed or not, transmission of a control signal and emission of light from a light-emitting unit are performed to concur with each other.

Illumination of the GAME device selection key 20*a*, the AMP selection key 20*b*, or the TV selection key 20*c* in the remote controller 10 has the benefit of notifying the user of the electronic device subject to control and of which the communication module 66 or the infrared light-emitting unit 64 is used as a means of transmitting the control signal. In other words, by illuminating the GAME device selection key 20*a*, the user can learn that the control signal is transmitted from the communication module 66 to the game device 2. By illuminating the AMP selection key 20*b*, the user can learn that the control signal is transmitted from the infrared light-emitting unit 64 to the AV amplifier 3. By illuminating the TV selection key 20*c*, the user can learn that the control signal is transmitted from the infrared light-emitting unit 64 to the television 4. The remote controller 10 is provided with two means of transmitting a control signal. By ensuring that there are more selection keys than there are transmission means, the user can know at a glance which transmission means is used and which electronic device the control signal is transmitted to.

<If the Input Key Information is Invalid Key Information>

Meanwhile, if the key input acknowledging unit 76 acknowledges user input from the invalid key while the current device information identifies the game device 2, i.e., while the game device 2 is selected as the target of remote control, the processing unit 70 refers to the invalid list for the game device 2 and determines that the input key information is for an invalid key. The command storage unit 78 may be provided with a command table that maps an invalid key to a NULL value. In this case, the processing unit 70 may determine that the input key information is for an invalid key by referring to the command table and finding that there are no corresponding command data.

In the state where the GAME device selection key 20*a* is pressed so that the game device 2 is selected as a target of remote control, the content of storage in the selection information storage unit 80 is as shown in FIG. 6B or FIG. 6D. When the key input acknowledging unit 76 acknowledges the user input from the invalid key and the processing unit 70 determines that the input key information is for the invalid key, the unit 70 refers to the previous device information 84 stored in the selection information storage unit 80.

The processing unit 70 refers to the previous device information 84 to identify the command table to use and reads the command data corresponding to the control key. If the previous device information 84 identifies the AV amplifier 3, the processing unit 70 refers to the command table for the AV amplifier 3 stored in the command storage unit 78 and reads the command data corresponding to the control key. Meanwhile, if the previous device information identifies the television 4, the processing unit 70 refers to the command table for the television 4 stored in the command storage unit 78 and reads the command data corresponding to the control key. The processing unit 70 generates a control signal and causes the infrared light-emitting unit 64 to transmit the control signal to control the AV amplifier 3 or the television 4 identified by the previous device information 84.

Thus, in the case that the game device 2 is being selected, the processing unit 70 does not discard invalid key information not assigned to the game device 2. Instead, the processing unit 70 uses the previous device information 84 to generate a control signal to control the AV amplifier 3 or the television 4. For example, this allows the user to change the volume, maintaining the selection of the game device 2 and without switching the target of control by pressing the AMP selection key 20*b* or the TV selection key 20*c*. Further, by using the previous device information 84, the electronic device used before the user uses the game device 2, i.e., the electronic device used before the user plays the game, can be defined as a target of control.

When the processing unit 70 receives the input key information for an invalid key, the unit 70 refers to the previous device information 84 and communicates information identifying the transmission destination of the control signal to the light-emission control unit 72. When the light-emission control unit 72 receives information identifying the transmission destination, the light-emission control unit 72 causes the light-emitting unit for the corresponding selection key to emit light for a predetermined period of time. For example, the light-emitting unit may emit light for 500 ms. Therefore, if the previous device information 84 identifies the AV amplifier 3, the light-emission control unit 72 causes the second light-emitting unit 62 corresponding to the AMP selection key 20*b* to emit light. If the previous device information 84 identifies the television 4, the light-emission control unit 72 causes the third light-emitting unit 63 corresponding to the TV selection key 20*c* to emit light.

Thus, when the processing unit 70 receives invalid key information not assigned to the game device 2 while the game device 2 is selected, the unit 70 generates a control signal to control the AV amplifier 3 or the television 4 and causes the light-emitting unit corresponding to the destination electronic device to emit light. This allows the user to know in which electronic device the volume is adjusted and learn the situation easily.

Figure 7:
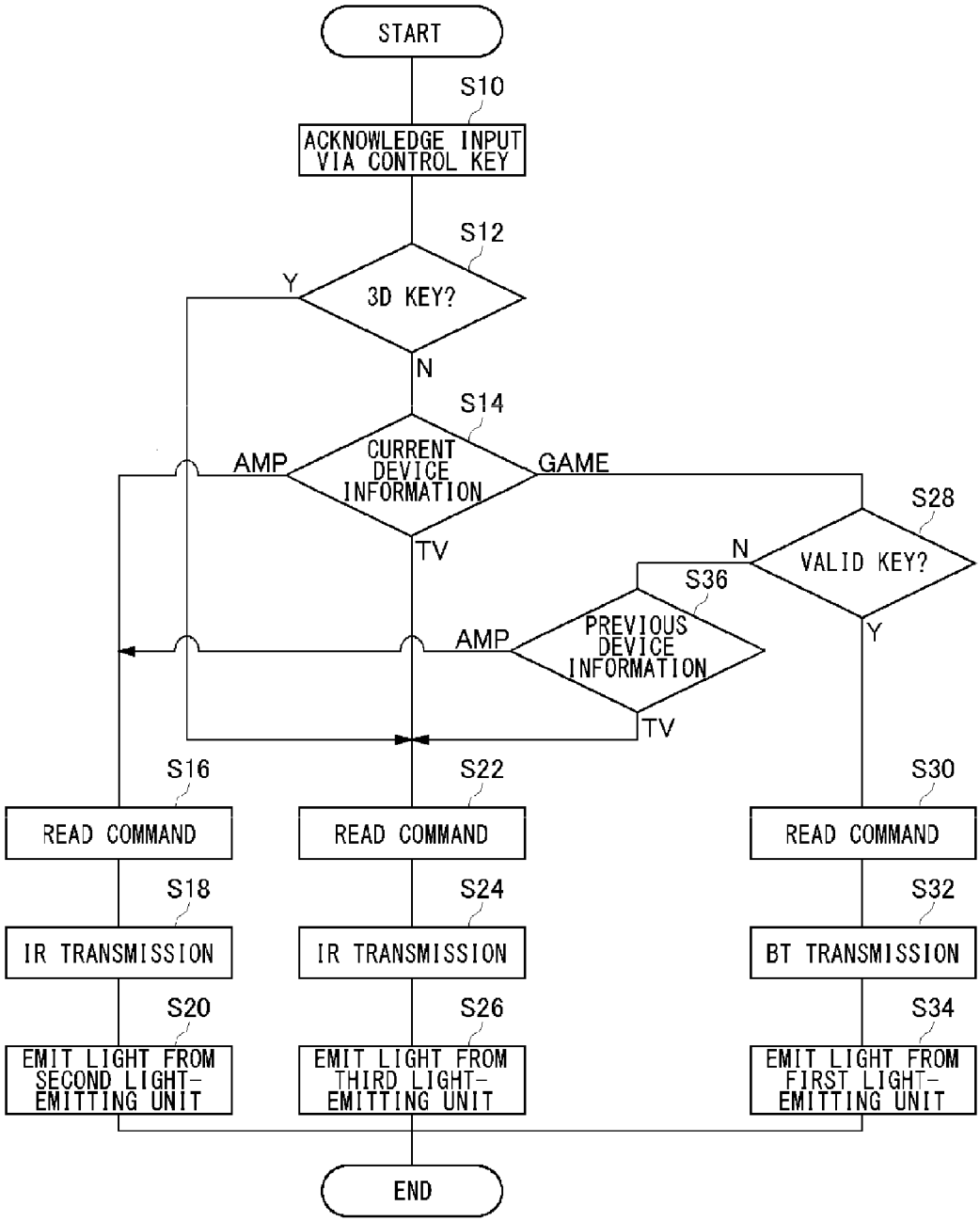
FIG. 7 is a flowchart showing how input key information for a control key is processed.

FIG. 7 is a flowchart showing how input key information for a control key is processed. The key input acknowledging unit 76 acknowledges the user input from the control key (S10) and transmits the input key information to the processing unit 70. The processing unit 70 determines whether the input key information is for the 3D key 38 (S12). Since the 3D key 38 is a control key enabled to control only the television 4, the processing unit 70 refers to the command table for the television 4 when the 3D key 38 is pressed (Y in S12) and reads the command data corresponding to the 3D key 38 (S22). The processing unit 70 generates a control signal including the read command data, causes the infrared light-emitting unit 64 to transmit the control signal (S24), and communicates information identifying the television 4, which is subject to control, to the light-emission control unit 72. This cause the light-emission control unit 72 to control the third light-emitting unit 63 to emit light for the TV selection key 20*c* corresponding to the television 4 for a predetermined period of time (S26).

If the input key information is not for the 3D key 38 (N in S12), the processing unit 70 refers to the current device information 82 and identifies the selected electronic device (S14).

If the current device information 82 identifies the AV amplifier 3 (AMP in S14), the processing unit 70 refers to the command table for the AV amplifier 3, reads the command data corresponding to the control key (S16), and generates a control signal including the read command data and designating the AV amplifier 3 as the transmission destination. The processing unit 70 causes the infrared light-emitting unit 64 to transmit the generated control signal to the AV amplifier 3 (S18). The light-emission control unit 72 causes the second light-emitting unit 62 corresponding to the AMP selection key 20*b* to emit light (S20).

If the current device information 82 identifies the television (TV in S14), the processing unit 70 refers to the command table for the television 4, reads the command data corresponding to the control key (S22), and generates a control signal including the read command data and designating the television 4 as the transmission destination. The processing unit 70 causes the infrared light-emitting unit 64 to transmit the generated control signal to the television 4 (S24). The light-emission control unit 72 causes the third light-emitting unit 63 corresponding to the TV selection key 20*c* to emit light (S26).

If the current device information 82 identifies the game device 2 (GAME in S14), the processing unit 70 refers to the invalid list to determine whether the input key information is for a valid key (S28). If the input key information is for a valid key (Y in S28), the processing unit 70 refers to the command table for the game device 2, reads the command data corresponding to the control key (S30), and delivers the command data to the communication module 66 via the communication control unit 74. The communication module 66 generates a control signal and transmits the control signal to the game device 2 according to the Bluetooth protocol (S32). The light-emission control unit 72 causes the first light-emitting unit 61 corresponding to the GAME device selection key 20*a* to emit light (S34).

If the input key information is for an invalid key (N in S28), the processing unit 70 refers to the previous device information 84 and selects the electronic device subject to control (S36). If the previous device information 84 identifies the AV amplifier 3 (AMP in S36), the processing unit 70 refers to the command table for the AV amplifier 3 stored in the command storage unit 78 so as to read the command data corresponding to the control key (S16). The processing unit 70 generates a control signal including the read command data and designating the AV amplifier 3 as the transmission destination and causes the infrared light-emitting unit 64 to transmit the control signal to the AV amplifier 3 (S18). Further, the light-emission control unit 72 causes the second light-emitting unit 62 corresponding to the AMP selection key 20*b* to emit light (S20).

If the previous device information 84 identifies the television 4 (TV in S36), the processing unit 70 refers to the command table for the television 4 stored in the command storage unit 78 so as to read the command data corresponding to the control key (S22). The processing unit 70 generates a control signal including the read command data and designating the television 4 as the transmission destination and causes the infrared light-emitting unit 64 to transmit the control signal to the television 4 (S24). Further, the light-emission control unit 72 causes the third light-emitting unit 63 corresponding to the television selection key 20*c* to emit light (S26).

Described above is an explanation based on an exemplary embodiment. The embodiment is intended to be illustrative only and it will be obvious to those skilled in the art that various modifications to constituting elements and processes could be developed and that such modifications are also within the scope of the present invention.

The communication control unit 74 according to the embodiment is described as breaking the connection between the communication module 66 and the game device 2 automatically if command data that should be transmitted is not supplied for a predetermined period of time. After disconnection, the communication control unit 74 may place the communication module 66 in a sleep state. To further save power consumption, the communication control unit 74 may break the connection between the communication module 66 and the game device 2 and place the communication module 66 in a sleep state, if the AMP selection key 20*b* or the TV selection key 20*c* is used to provide an input even before an elapse of a predetermined period of time while the game device 2 is being selected as a target of remote control. This suppresses battery consumption in the communication module 66 and achieves power saving.

More specifically, when the processing unit 70 receives input key information for the AMP selection key 20*b* or the TV selection key 20*c*, the processing unit 70 directs the communication control unit 74 to break the communication link. Thus, where a plurality of transmission means are available, wasteful use of a battery is avoided by suspending the use of one communication means once the use of another communication means is started.

The remote controller 10 may not be a key to be pressed for use but may be a software key displayed on a touch panel. In this case, the key input acknowledging unit 76 identifies the selected key by referring to the position of touching selected by the user and supplies the input key information to the processing unit 70.

Figure 8:
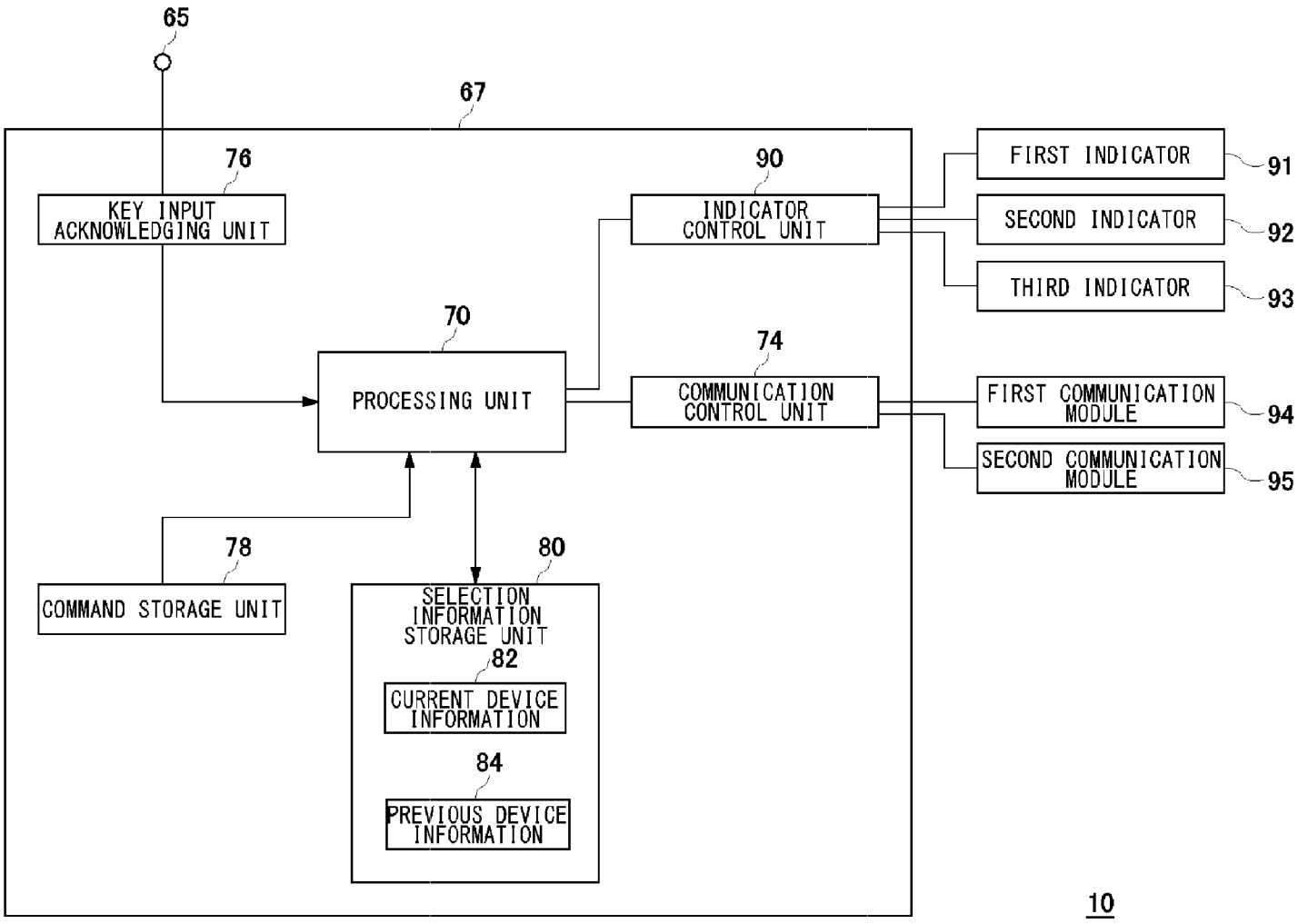
FIG. 8 shows a variation of the functional blocks of the remote controller.

FIG. 8 shows a variation of the functional blocks of the remote controller 10. In FIG. 8, those functional blocks assigned the same reference symbols as in FIG. 5 have the same or similar functions as the functional blocks described with reference to FIG. 5. In this variation, it is assumed that at least the selection keys are displayed on the screen as software keys.

In the variation shown in FIG. 8, a first indicator 91, a second indicator 92, and a third indicator 93 that respectively change the status of a plurality of selection keys are provided in place of the first light-emitting unit 61, the second light-emitting unit 62, and the third light-emitting unit 63 in the embodiment. An indicator control unit 90 controls the first indicator 91, the second indicator 92, and the third indicator 93. An indicator may be decorative touch or optical effect added to the selection key that notifies the user of the transmission destination of the control signal.

In this variation, the selection key group 20 and the control key group 30 shown in FIG. 2 are displayed on a display such as a touch panel as software keys. Not all keys may be software keys, and some of the keys may be keys pressed for use. The indicator control unit 90 changes the mode of displaying the selection key in order to notify the user of the electronic device that is the transmission destination. The command for this purpose is provided from the processing unit 70 like the command for light emission in the remote controller 10 shown in FIG. 5. The remote controller 10 shown in FIG. 5 is configured to notify the user of the transmission destination by causing the light-emitting unit to emit light. The remote controller 10 shown in FIG. 8 is configured to notify the user of the transmission destination by changing the mode of displaying the selection key.

Further, the remote controller 10 shown in FIG. 8 is provided with a first communication module 94 and a second communication module 95. The first communication module 94 may be identical to the Bluetooth communication module 66. The second communication module 95 may be a WLAN communication module or a communication module that complies with another communication scheme. The requirement is that the remote controller 10 be provided with a plurality of communication modules and the type is non-limiting.

What is claimed is:

1. A remote controller configured to transmit a control signal to an electronic device, comprising:

a plurality of control keys;

a first transmission unit provided with a function of transmitting a control signal;

a second transmission unit provided with a function of transmitting a control signal;

a plurality of selection keys configured to select a transmission destination of a control signal;

an acknowledging unit configured to acknowledge user input from the plurality of control keys or from the plurality of selection keys;

a plurality of indicators configured to change the status of the plurality of selection keys, respectively; and an indicator control unit configured to control a mode of the indicators, wherein the plurality of selection keys at least include:

a first selection key configured to select a first electronic device to which the first transmission unit transmits a control signal; and a second selection key configured to select a second electronic device to which the second transmission unit transmits a control signal, wherein, when the acknowledging unit acknowledges the user input from among the plurality of control keys while an electronic device is selected, the indicator control unit changes the mode of an indicator for a selection key corresponding to the selected electronic device thereby indicating the device currently subject to remote control, wherein when the acknowledging unit acknowledges the user input from a valid key enabled to control the first electronic device while the first electronic device is selected, the indicator control unit changes the mode of the indicator for the first selection key, and wherein when the acknowledging unit acknowledges the user input from a control key other than the valid key while the first electronic device is selected, the control key controls a last used device instead of the first electronic device by causing a control signal to be sent to the last used device, and the indicator control unit changes the mode of the indicator for the selection key associated with the last used device.

2. The remote controller according to claim 1, further comprising:

a storage unit configured to store last used device information indicating which device was selected immediately before the first selection key is operated, when the acknowledging unit acknowledges the user input from a control key other than a valid key enabled to control the first electronic device while the first selection key is operated to select the first electronic device, the second transmission unit transmits a control signal to the electronic device identified by the last used device information.

3. The remote controller according to claim 2, wherein, when the acknowledging unit acknowledges the user input from the control key other than the valid key while the first electronic device is selected, the indicator control unit changes the mode of the indicator for the selection key corresponding to the last used device information.

4. The remote controller according to claim 2, further comprising a third selection key configured to select a third electronic device to which the second transmission unit transmits a control signal, wherein the storage unit stores current device information identifying a currently selected electronic device.

5. The remote controller according to claim 4, further comprising: a communication control unit configured to break communication between the first transmission unit and the first electronic device, when the second selection key or the third selection key is operated while the first electronic device is selected.

6. A remote controller configured to transmit a control signal to an electronic device, comprising:

a plurality of control keys;

a first transmission unit provided with a function of transmitting a control signal;

a second transmission unit provided with a function of transmitting a control signal;

a plurality of selection keys configured to select a transmission destination of a control signal;

an acknowledging unit configured to acknowledge user input from the plurality of control keys or from the plurality of selection keys; and an indicator control unit configured to control an indicator, wherein the plurality of selection keys at least include:

a first selection key configured to select a first electronic device to which the first transmission unit transmits a control signal;

a second selection key configured to select a second electronic device to which the second transmission unit transmits a control signal; and a third selection key configured to select a third electronic device to which the second transmission unit transmits a control signal, and wherein, when the acknowledging unit acknowledges the user input from among the plurality of control keys while an electronic device is selected, the indicator control unit causes an indicator of a selection key corresponding to the selected electronic device to change a status of the selection key, wherein when the acknowledging unit acknowledges the user input from a valid key enabled to control the first electronic device while the first electronic device is selected, the indicator control unit changes the mode of the indicator for the first selection key, and wherein when the acknowledging unit acknowledges the user input from a control key other than the valid key while the first electronic device is selected, the control key controls the last used device instead of the first electronic device by causing a control signal to be sent to the last used device, and the indicator control unit changes the mode of the indicator for the selection key associated with the last used device.

7. A method of controlling an indicator in a remote controller provided with a plurality of control keys, a transmission unit having a function of transmitting a control signal, a plurality of selection keys configured to select a transmission destination of a control signal, and a plurality of indicators for the plurality of selection keys, respectively, the method comprising:

acknowledging user input from a control key while an electronic device that is the transmission destination is selected;

determining whether the acknowledged user input is valid or invalid for the selected electronic device;

controlling a mode of an indicator for a selection key corresponding to the selected electronic device if the acknowledged user input is valid for the selected electronic device; and controlling a mode of the indicator for the selection key corresponding to a last used device if the acknowledged user input is invalid for the selected electronic device and concurrently controlling the last used device via the control key instead of the first electronic device by causing a control signal to be sent to the last used device.

8. A computer being provided with a plurality of control keys, a transmission unit having a function of transmitting a control signal, a plurality of selection keys configured to select a transmission destination of a control signal, and a plurality of indicators configured to change the status of the plurality of selection keys respectively, the computer operating a program for causing the computer to execute actions, comprising:

acknowledging user input from a control key while an electronic device that is the transmission destination is selected;

determining whether the acknowledged user input is valid or invalid for the selected electronic device;

causing an indicator to change the status of for a selection key corresponding to the selected electronic device if the acknowledged user input is valid for the currently selected electronic device; and an indicator to change the status of for the selection key corresponding to a last used device if the acknowledged user input is invalid for the currently selected electronic device and concurrently controlling the last used device via the control key instead of the first electronic device by causing a control signal to be sent to the last used device.

9. A non-transitory computer-readable recording medium having embodied thereon the program adapted to cause a computer to run modules, the computer being provided with a plurality of control keys, a transmission unit having a function of transmitting a control signal, a plurality of selection keys configured to select a transmission destination of a control signal, and a plurality of indicators configured to change the status of the plurality of selection keys respectively, the program comprising:

a module configured to acknowledge user input from a control key while an electronic device that is the transmission destination is selected;

a module configured to determine whether the acknowledged user input is valid or invalid for the selected electronic device;

a module configured to cause an indicator to change the status of for a selection key corresponding to the selected electronic device if the acknowledged user input is valid for the selected electronic device; and a module configured to cause an indicator to change the status of the selection key corresponding to a last used device if the acknowledged user input is invalid for the currently selected electronic device and concurrently controlling the last used device via the control key instead of the first electronic device by causing a control signal to be sent to the last used device.

* * * * *